US006623085B2

(12) United States Patent
Chang

(10) Patent No.: US 6,623,085 B2
(45) Date of Patent: Sep. 23, 2003

(54) METHOD FOR MAKING BATH SCRUBBER FOR USE IN CLEANING BODY SKIN

(76) Inventor: Che-Yuan Chang, No. 1, Lane 147, Sec. 2, Chung San Rd., Yun lin, Chang Hua Hsien (TW)

( * ) Notice: Subject to any disclaimer, the term of this patent is extended or adjusted under 35 U.S.C. 154(b) by 225 days.

(21) Appl. No.: 09/940,595

(22) Filed: Aug. 29, 2001

(65) Prior Publication Data

US 2003/0001428 A1 Jan. 2, 2003

(30) Foreign Application Priority Data

Jun. 27, 2001 (TW) ..... 90115537 A

(51) Int. Cl.[7] ..... A47K 7/02
(52) U.S. Cl. ..... 300/21; 15/209.11; 15/229.11
(58) Field of Search ..... 300/21; 15/209.1, 15/229.11; 29/446; 66/1 R, 1 A, 4; 28/147, 150; 223/46, 44

(56) References Cited

U.S. PATENT DOCUMENTS 5,144,744 A 9/1992 Campagnoli
5,709,434 A 1/1998 Chen
5,946,780 A 9/1999 Borcherds et al.
5,970,566 A * 10/1999 Girardot et al. ..... 15/229.11
6,227,621 B1 * 5/2001 Chen ..... 300/21
6,443,527 B1 * 9/2002 Borcherds et al. ..... 300/21

* cited by examiner

*Primary Examiner*—Robert J. Warden, Sr.
*Assistant Examiner*—Shay Balsis
(74) *Attorney, Agent, or Firm*—Browdy and Neimark, P.L.L.C.

(57) ABSTRACT

A method for making a bath scrubber for use in cleaning the body skin involves a tubular net main body which is fitted over two support members separated from each other by a predetermined distance. The main body is then tightened. The present invention is characterized in that the main body is pulled alternatively with one hand toward one direction and other hand toward other direction, and each time when the tubular net body is pulled, a portion of the tubular body is pulled out of the two support members synchronously until the tubular net body is completely pulled out of the two support members, thereby enabling the main body to expand along the tightening point to form a spherical body.

2 Claims, 5 Drawing Sheets

METHOD FOR MAKING BATH SCRUBBER FOR USE IN CLEANING BODY SKIN

FIELD OF THE INVENTION

The present invention relates generally to a bath scrubber for cleaning the body skin, and more particularly to a method for making the bath scrubber.

BACKGROUND OF THE INVENTION

The U.S. Pat. No. 5,144,744 discloses a method for making a bath sponge for cleaning the body skin. The method includes a first step in which a plurality of tubes made of resilient synthetic netting are stretched in a direction transverse to a longitudinal axis of the tubes. Thereafter, all of the stretched tubes are bound together near a common center of all of the stretched tubes. Finally, all of the tubes are released from their stretched condition, whereby the tubes through their resiliency rebound into a rounded sponge shape around the binding of the tubes.

The U.S. Pat. No. 5,709,434 discloses a method for making a bath scrubber for cleaning the body skin. The method comprises the steps of:

(a) arranging a first bracing member and a second bracing member such that said first bracing member and said second bracing member are parallel to each other and are fixed respectively at a bottom end thereof;

(b) fitting a tubular network body from top ends of said bracing members such that said tubular body embraces said bracing members, and that said tubular body is stretched by said bracing members;

(c) lashing centers of two stretched sides of said tubular body;

(d) stretching further one stretched side of said tubular body by pulling said one stretched side to pass over a top end of said second bracing member towards said first bracing member;

(e) stretching further another stretched side of said tubular body by pulling said another stretched side to pass over a top end of said first bracing member towards said second bracing member such that said another stretched side and said one stretched side are superimposed with each other; and (f) repeating steps (d) and (e) referred to above until said tubular body is completely disengaged with said first bracing member and said second bracing member so as to form a bath scrubber of a spherical construction.

The U.S. Pat. No. 5,946,780 discloses a method for making a bath spongy body. The method involves a first step in which a netting tube over two spaced apart upright supports is stretched to form a telescopically gathered continuous band around said supports. Thereafter, a loop is wrapped end of a cord around opposed portions of said band between said upright supports so as to form a cow hitch around said opposed portions of said band. Finally, a portion of said cord is pulled through an aperture of a loop fastener such that said loop fastener engages against said cow hitch and fictionally locks on said cord, thereby preventing unwanted disengagement of said cow hitch around said opposed portions of said band, and progressively releasing over respective upper ends of said spaced supports opposed portions of said telescopically gathered continuous band to form a generally spherical bath ruffle or sponge.

The above methods make use of two support members of a predetermined distance to fit with the tubular net main body. The center of the main body is lashed and then released. The U.S. Pat. No. 5,144,744 makes use of a plurality of tubes, which are pulled from one side and then released. The U.S. Pat. No. 5,709,434 makes use of the main body whose left and right sides are respectively taken out repeatedly toward other end from the support member. In the meantime, they are stretched and then stacked together. The U.S. Pat. No. 5,946,780 makes use of the net band whose left and right sides are stretched upwards from the support member and are then pulled in reverse at a predetermined angle. In practice, the prior art methods are defective in design in that the density of the periphery of the product is often uneven, and that the stacking process is time-consuming, thereby resulting in an increase in production cost. In addition, the tubular net body is caught from one side with one hand, thereby resulting in the jamming of the stacked net bodies. As a result, the net body is partially spongy due to the fact that the net body is not fully supported from beginning to the end.

SUMMARY OF THE INVENTION

It is the primary objective of the present invention to provide a method for making a bath scrubber having a uniform density.

It is another objective of the present invention to provide a method for making a bath scrubber which is cost-effective.

The method of the present invention involves a tubular net main body which is fitted with two support members that are separated from each other by a predetermined distance. The main body is then appropriately stretched along the two support members. The center of the main body is then lashed. The present invention is characterized in that the tubular net body is pulled alternatively with one hand toward one direction and other hand toward other direction, and each time when the tubular net body is pulled, a portion of the tubular body is pulled out of the two support members synchronously until the tubular net body is completely pulled out of the two support members. The main body is released along the lashing point to swell so as to become a spherical body.

DETAILED DESCRIPTION OF THE INVENTION

Figure 1:
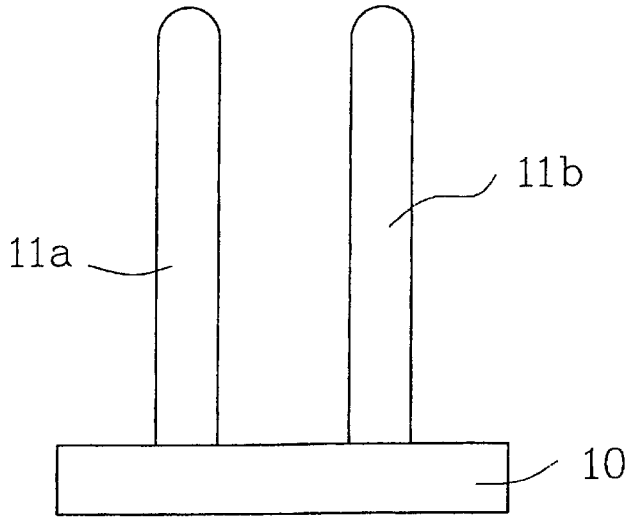
FIG. 1 shows a schematic view of the support member of a preferred embodiment of the present invention.
Figure 2:
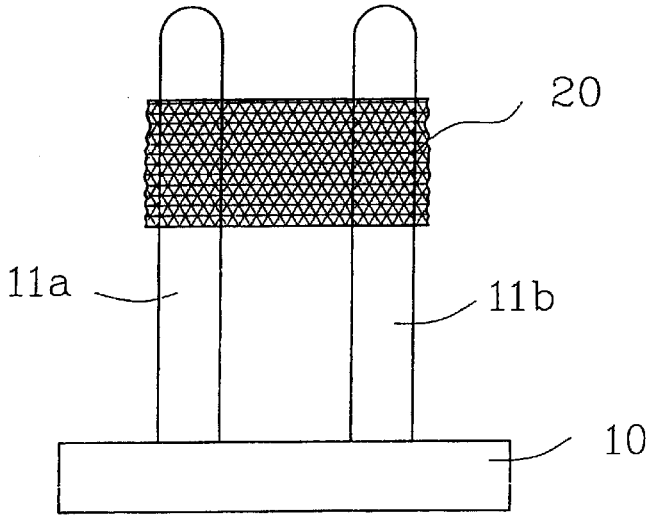
FIG. 2 shows a schematic view of a tubular net body of the preferred embodiment of the present invention which is fitted with the support member as shown in FIG. 1.
Figure 3:
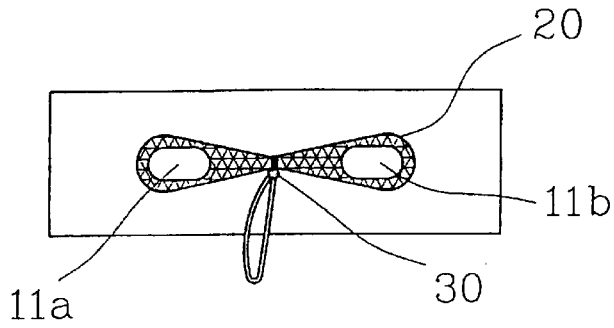
FIG. 3 shows a schematic view of a strip which is used to tighten up the center of a tubular net main body of the preferred embodiment of the present invention.
Figure 4A:
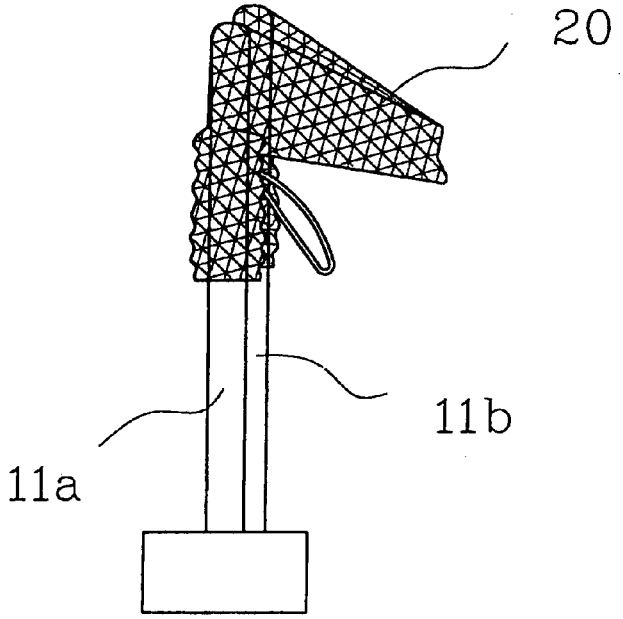
FIGS. 4A and 4B are schematic views of initial holding of the tubular net main body of the present invention in different side directions.
Figure 4B:
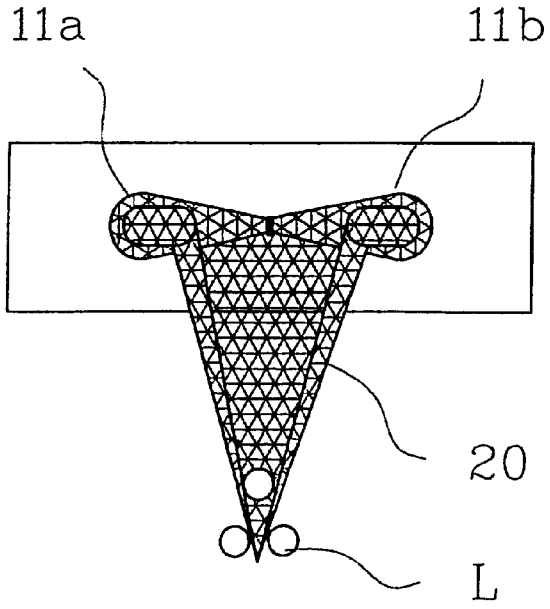
Figure 5:
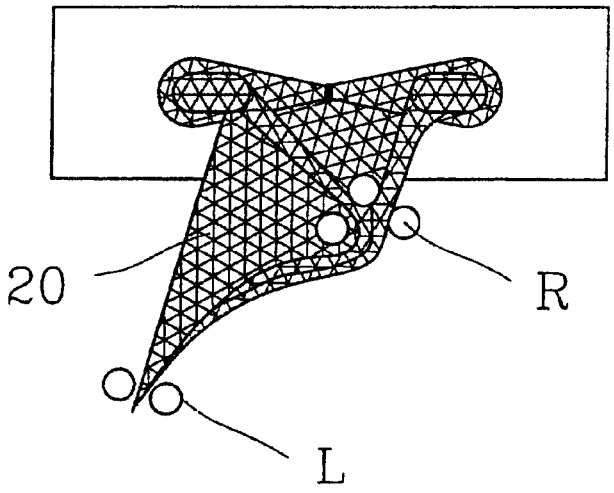
FIGS. 5A and 5B are continuous schematic views of the second holding of the tubular net main body of the present invention.
Figure 5:
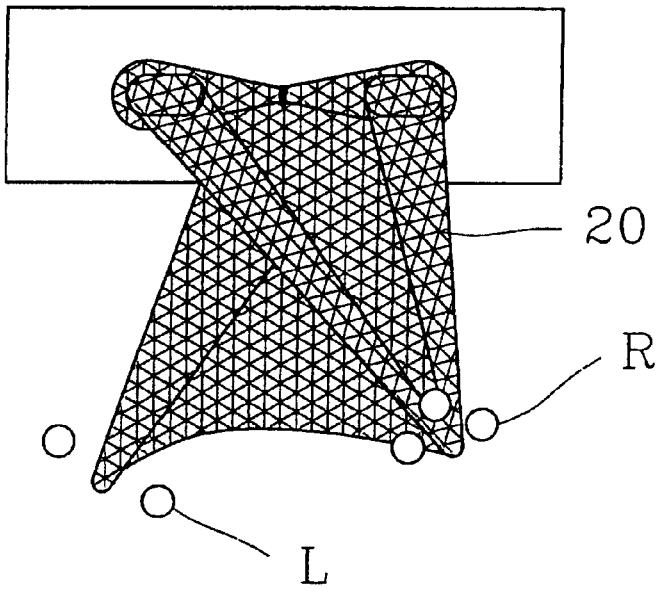
Figure 6:
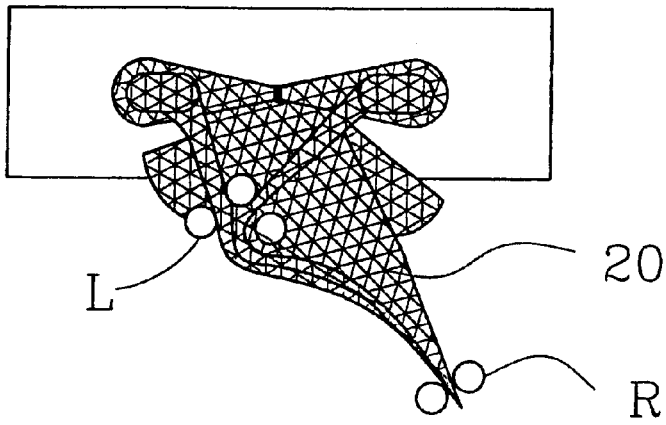
FIGS. 6A and 6B are continuous schematic view of the third holding of the tubular net main body of the present invention.
Figure 6:
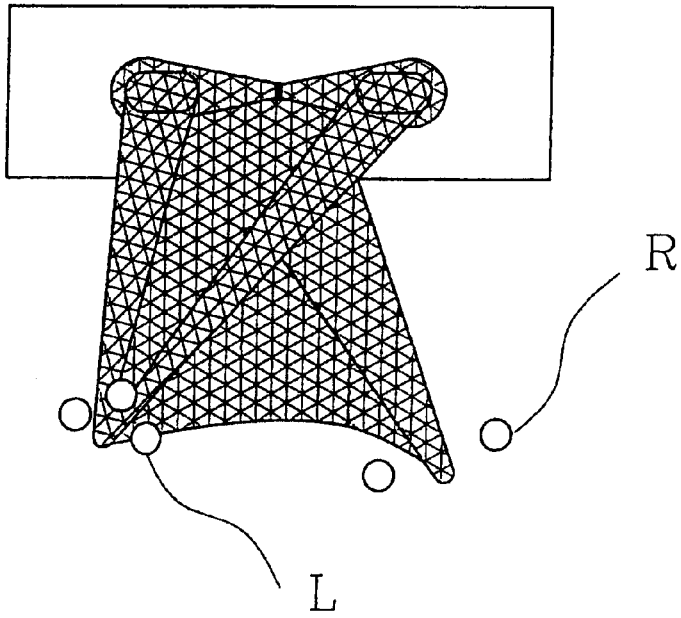
Figure 7:
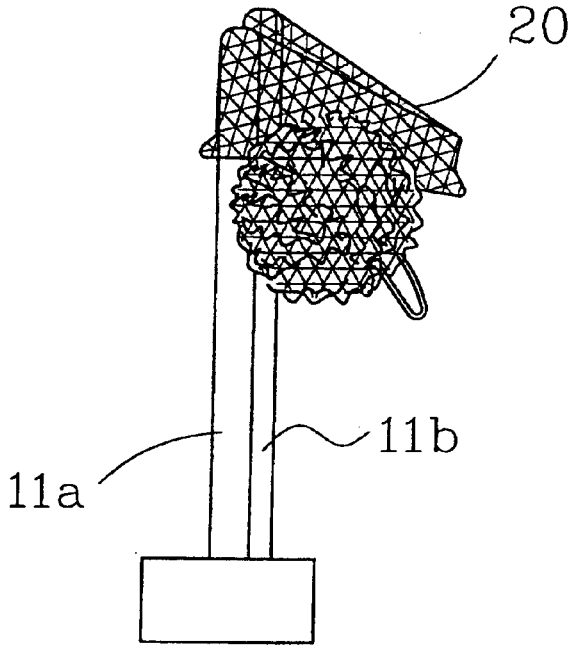
FIG. 7 shows a schematic view of the tubular net main body of the present invention being completely taken out.
Figure 8:
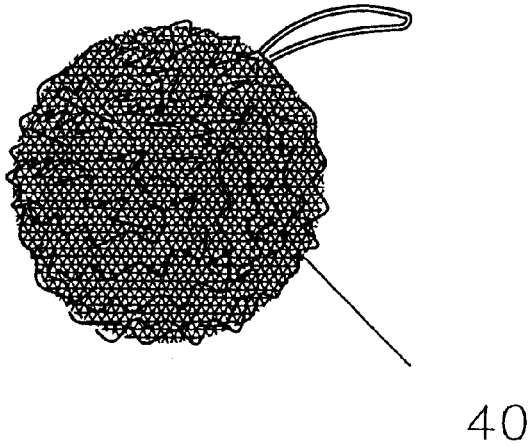
FIG. 8 shows a schematic view of a finished product of the present invention.

As shown in all drawings provided herewith, the present invention comprises the following steps:

a) As shown in FIG. 1, a base board 10 is vertically provided with a first support member 11*a* and a second support member 11*b*, which are parallel to each other and are separated from each other by a predetermined distance;

b) As shown in FIG. 2, a long tubular net main body 20 is fitted on the two support members 11*a* and 11*b* such that the main body 20 is stretched and stacked continuously by the two support members;

c) As shown in FIG. 3, the center of the main body 20 is tightened by a lashing strap 30 such that the center has a knot, and that the outer portions of the main body 20 are disheveled;

d) As shown in FIGS. 4A and 4B, the opening of the top end of the main body 20 are synchronously caught with two hands to move out of the two support members 11*a* and 11*b*, so as to hold it together in one hand (L), either left hand or right hand;

e) As shown in FIGS. 5A and 5B, with one hand (R), a portion of the tubular net main body is moved at the center of the top end thereof from the two support members toward the operator so as to hold it together into point. In the meantime, the left hand is let go, as shown in FIG. 5B, the right hand holds the main body which is moved to the right. The main body 20 coming from the first support member 11*a* or the main body 20 coming from the second support member 11*b* will not obstruct each other, thereby being completely pulled and supported;

f) As shown in FIGS. 6A and 6B, when the tubular net main body 20 in the right hand (R) is not let go, the center of the top end of the top end of the tubular net main body is caught by the left hand (L) to move toward the operator to join into point. In the meantime, right hand is let go, left hand pulls toward the left, as shown in FIG. 6B;

g) As shown in FIG. 7, repeat (e)(f) steps alternately until the main body 20 is completely taken out of the two support members 11*a* and 11*b*. The main body is let go along the tightening point to swell to become a spherical body 40, as shown in FIG. 8.

The spherical body 40 is made of the tubular net body 20 of the two support members 11*a* and 11*b* by one hand catching then at the same time, thereby saving time in production process. The present invention has an even density and is well disheveled.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following claims.

What is claimed is:

1. A method for making a bath scrubber for use in cleaning the body skin, said method comprising the steps of:

(a) disposing uprightly on a base board two support members parallel to each other and separated from each other by a predetermined distance;

(b) fitting a tubular net main body with the two support members such that the tubular net main body is stretched and stacked continuously;

(c) tightening the center of the main body with a lashing member forming two openings in the tubular net main body;

(d) holding the two openings of the top end of the tubular net main body surrounding the two support members with a first hand such that a first portion of the main body is pulled toward an operator so as to join together to form a first concentration point, which is then pulled toward one side;

(e) before releasing the pulled portion of the main body of step (d), a second hand grabs and pulls a second portion of the tubular net main body surrounding the two support members toward the body of the operator to join to form a second concentration point, then releasing the pulled portion of the tubular main body of the step (d), and pulling continuously toward other side;

(f) repeating alternately the steps (d) and (e), so as to take the main body completely out of the two support members, thereby enabling the main body to swell along a tightening point serving as the center to form a spherical body having a uniform density.

2. The method as defined in claim 1, further comprising a step between the steps (c) and (d), the step involving the use of two hands to catch synchronously the opening of the top end of the tubular main body so as to take the tubular main body out of the two support members such that the tubular main body is contracted into one body which is held in one hand.

* * * * *